US008007165B1

(12) United States Patent
Lalo

(10) Patent No.: US 8,007,165 B1
(45) Date of Patent: Aug. 30, 2011

(54) COUPLING ASSEMBLY FOR A WRISTWATCH

(75) Inventor: Eyal Lalo, Hallandale, FL (US)

(73) Assignee: Invicta Watch Company of America, Inc., Hollywood, FL (US)

( * ) Notice: Subject to any disclaimer, the term of this patent is extended or adjusted under 35 U.S.C. 154(b) by 23 days.

(21) Appl. No.: 12/709,043

(22) Filed: Feb. 19, 2010

(51) Int. Cl.
*A44C 5/14* (2006.01)
*G04B 37/00* (2006.01)

(52) U.S. Cl. ..... 368/282; 24/265 WS; 224/180

(58) Field of Classification Search ..... 368/281–283; 224/164–180; 24/265 WS, 265 R
See application file for complete search history.

(56) References Cited

U.S. PATENT DOCUMENTS

| | | | | | |
|---|---|---|---|---|---|
| 2,089,638 | A * | 8/1937 | Becker | 24/265 WS |
| 3,612,365 | A * | 10/1971 | Dintsman | 24/265 WS |
| 4,432,655 | A * | 2/1984 | Wollman | 368/282 |
| 4,539,736 | A * | 9/1985 | Yokosuka | 24/644 |
| 4,722,179 | A * | 2/1988 | Tesch | 59/82 |
| 5,146,437 | A * | 9/1992 | Boucheron | 368/282 |
| 5,341,552 | A * | 8/1994 | Voumard | 29/896.33 |
| 6,130,861 | A * | 10/2000 | Della Felice | 368/276 |
| 6,176,612 | B1 * | 1/2001 | Chagnoux | 368/282 |
| 6,408,491 | B2 * | 6/2002 | Guyard | 24/265 WS |
| 6,449,812 | B1 * | 9/2002 | Calce | 24/265 WS |
| 7,300,201 | B2 * | 11/2007 | Man | 368/282 |
| 7,526,840 | B2 * | 5/2009 | Pernu et al. | 24/265 WS |
| 7,682,069 | B2 * | 3/2010 | Hyatt | 368/282 |
| 2003/0002394 | A1 * | 1/2003 | Kinkio et al. | 368/281 |
| 2005/0111306 | A1 * | 5/2005 | Saaski et al. | 368/282 |
| 2005/0150086 | A1 * | 7/2005 | Kato | 24/265 WS |
| 2005/0207284 | A1 * | 9/2005 | Hiranuma et al. | 368/282 |
| 2006/0280038 | A1 * | 12/2006 | Hiranuma et al. | 368/282 |
| 2007/0028428 | A1 * | 2/2007 | Cretin | 24/265 WS |
| 2008/0210722 | A1 * | 9/2008 | Ishihara et al. | 224/180 |
| 2008/0225649 | A1 * | 9/2008 | Andren et al. | 368/282 |

* cited by examiner

*Primary Examiner* — Sean Kayes
(74) *Attorney, Agent, or Firm* — Howard Natter; Natter & Natter

(57) ABSTRACT

A releasable coupling assembly for securing a wristband to a watchcase. A pair of lug members extending from a top and a bottom sidewall of the watchcase provides respective alignment slots. The respective ends of a flexible wristband include a rigid connector member and guide pins registrable with the alignment slots. The sidewall has a notched surface adapted for engaging a complementary raised surface of the connector member to securely position the wristband with respect to the watchcase. A locking pin is selectively insertable through an aperture in one of said lug members and threadably connected to the other of said lug members to form an integral connection with the watchcase.

11 Claims, 2 Drawing Sheets

FIG. 3
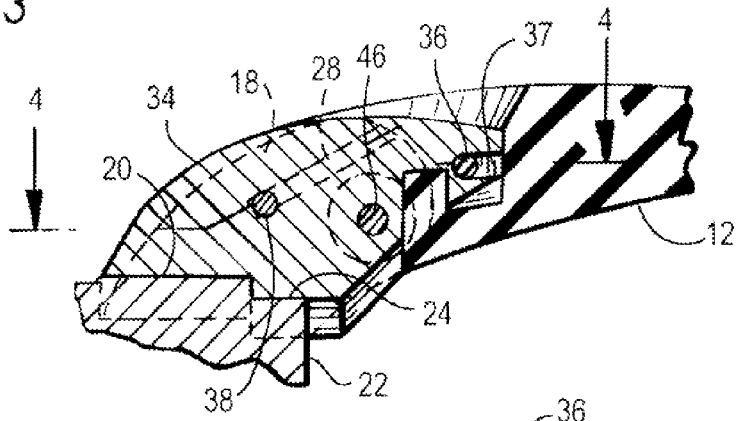
FIG. 4
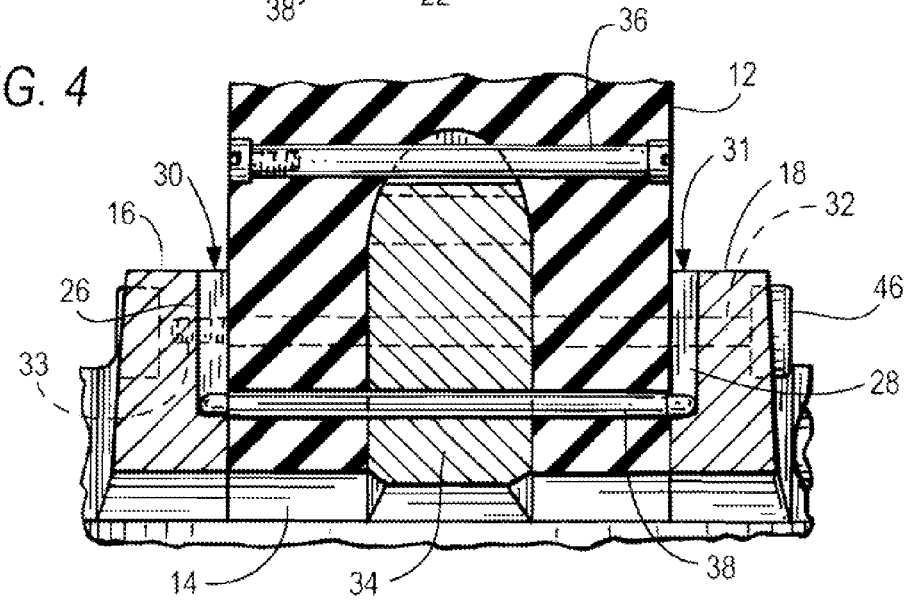
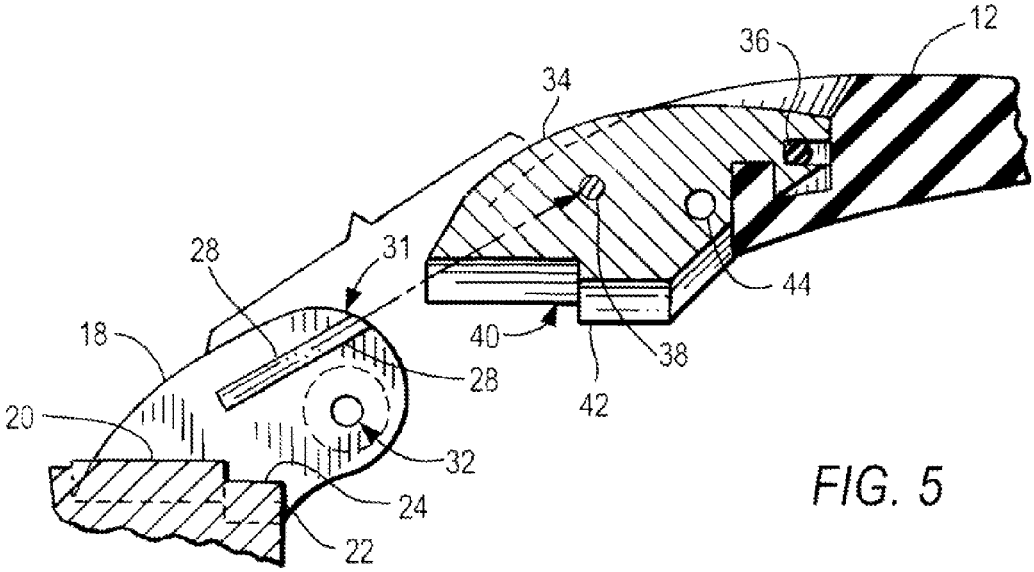
FIG. 5

COUPLING ASSEMBLY FOR A WRISTWATCH

BACKGROUND OF THE INVENTION

1. Field of the Invention

This invention relates to watches and especially to watches attached to a band extendable circumferentially around the wrist of the wearer.

In particular, this invention concerns a non-articulated coupling assembly for securing an end of a wristband to a watchcase.

2. Description of Related Art

Wristwatches typically include a watchcase provided with a set of spaced apart projecting lugs at a top and a bottom of the watchcase. Each set of lugs is bridged by a cross-bar having a retractable spring-biased pin extending axially from the cross-bar. The pin is adapted to be received within a cavity formed in each of the lugs. The tail ends of a wristband are looped or provided with a transverse bore to accommodate the cross-bar whereby the wristband can be linked to the watchcase and pivoted around the cross-bar for extending circumferentially around the wrist of the wearer.

In order to replace a wristband, the pins must be displaced inwardly with a suitable tool to release the cross-bar from the lugs after which the bar and wristband can be decoupled from the watchcase. A disadvantage of this coupling arrangement is that, in many instances, this operation must be performed by a jeweler having a special tool for releasing the retractable pins.

Another shortcoming of the above described wristband attachment is that it is not adapted for wristwatch designs wherein the watchcase and wristband are integral for aesthetic purposes so as not to leave a gap between the watchcase and the wristband.

Although various coupling arrangements have attempted to overcome this problem, such as is shown in U.S. Pat. Nos. 4,432,655 and 7,300,201, the band linkage disclosed in these patents is only suitable for joining a linear surface of a watchcase to a linear end of a wristband.

U.S. Pat. No. 5,398,218 discloses a curvilinear surface of a watchcase connected to a linear surface of a wristband, however, the watchcase is not integrated with the wristband.

SUMMARY OF THE INVENTION

Briefly, this invention concerns a coupling assembly for providing a rigid, gapless, connection between a watchcase and a wristband. The watchcase includes a pair of spaced apart lug members projecting from a sidewall of the watchcase, said lug members having confronting surfaces defining respective alignment slots. An end of a flexible wristband includes a nonflexible connector member. A transverse guide pin extending from opposite sides of the wristband is engageable within the alignment slots for positioning an abutment surface of the connector member in contact with the sidewall of the watchcase. A locking pin releasably secures the wristband to the lug members to effect an integral connection between the wristband and the watchcase.

Having thus summarized the invention, it will be seen that it is a preferred object thereof to provide an improved coupling assembly of the general character described herein which is not subject to the previously mentioned limitations.

Another preferred object of this invention is to provide a coupling assembly that provides a non-pivotal connection between a wristband and a sidewall of the watchcase.

Yet still another preferred object of this invention is to provide a coupling assembly for surface to surface contact between an end of a wristband and a sidewall of a watchcase.

A further preferred object of this invention is to provide a coupling assembly wherein the wristband is disposed with respect to the watchcase for extension circumferentially around the wrist of the wearer.

An additional preferred object of this invention is to provide a coupling assembly wherein the juncture between the wristband and the watchcase provides a generally continuous and uninterrupted surface.

With these ends in view, the invention finds embodiment in certain combinations of elements and arrangements of parts by which the aforementioned preferred objects and certain other objects are hereinafter attained, all as more fully described with reference to the accompanying drawings and the scope of which is more particularly pointed out herein.

BRIEF DESCRIPTION OF THE DRAWINGS

In the accompanying drawings, in which is shown an exemplary embodiment of the invention:

FIG. 3 is a sectional view taken substantially along long line 3-3 of FIG. 1 showing an abutment surface of the connector member in contiguous contact with the sidewall of the watchcase;

FIG. 4 is a sectional view taken substantially along line 4-4 of FIG. 3 detailing the guide pin within the respective alignment slots and a retaining pin for securing the connector member within the wristband; and FIG. 5 is a fragmentary exploded view, partially in section, illustrating engagement of the guide pin within the alignment slot.

DETAILED DESCRIPTION OF THE INVENTION

With specific reference now to the figures in detail, it is stressed that the particulars shown are by way of example and for the purposes of illustrative discussion of the preferred embodiment of the present invention only and are presented in the cause of providing what is believed to be the most useful and readily understood description of the principles and conceptual aspects of the invention. In this regard no attempt has been made to show aspects of the invention in more detail than is necessary for a fundamental understanding of the invention, the description taken with the drawings should make it apparent to those skilled in the art how the preferred form of the invention may be embodied in practice.

Figure 1:
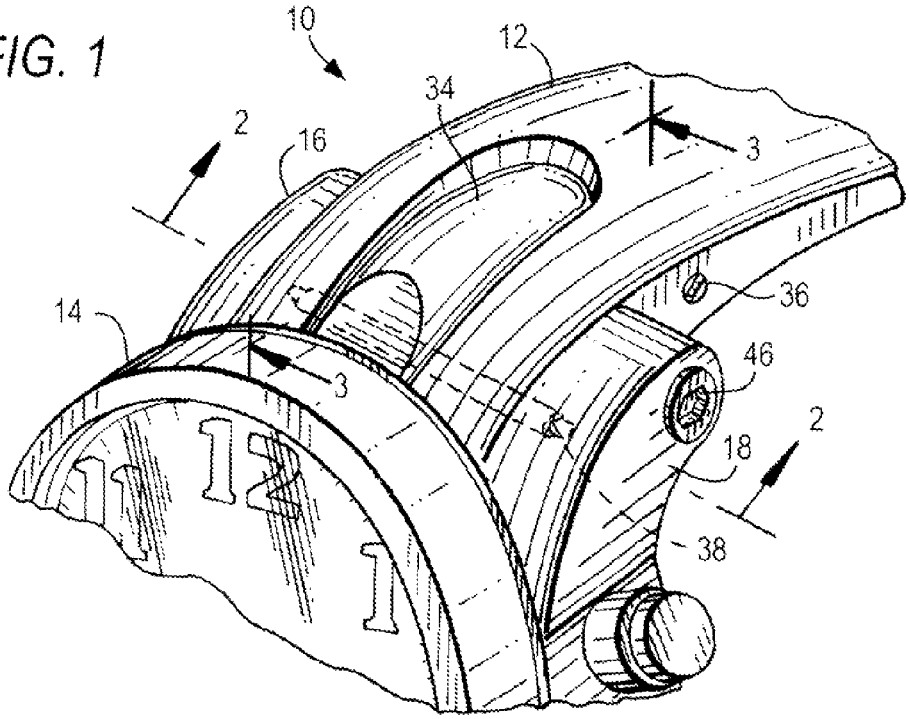
FIG. 1 is a partial prospective view of a coupling assembly in accordance with this invention showing a wristband secured to a watchcase.

Referring now in detail to FIG. 1 of the drawings, there is shown a coupling assembly 10 of this invention. The coupling assembly 10 provides for releasable securement of an end of a wristband 12 to a watchcase 14. As referred to herein, the wristband 12 should be understood as encompassing a flexible strap comprised of leather, rubber, elastomers, such as polyurethane, or a combination of these or similar materials and/or a bracelet comprised of metal links or a combination of metal and nonmetal links or steel mesh or the equivalent.

The watchcase 14 includes a set of complementary spaced apart lug members 16, 18 extending from the top of a sidewall 20 of the watchcase 14 in a generally downwardly direction with respect to a horizontal plane of the watchcase 14. It should be understood that a similar set of lug members (not shown) may extend from the bottom of the sidewall 20.

In this preferred embodiment the sidewall 20 defines a curvilinear surface. Furthermore, the juxtaposition of the sidewall 20 and a rear access plate 22 defines a notch 24 being coextensive with the sidewall 20 as will be discussed hereinafter.

Figure 2:
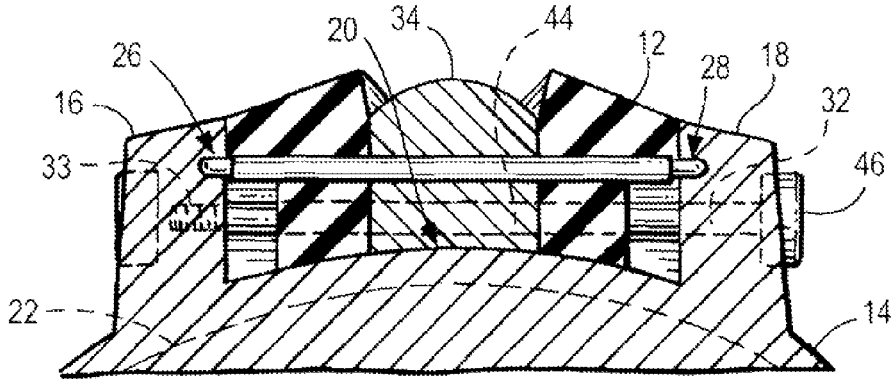
FIG. 2 is a sectional view taken substantially along line 2-2 of FIG. 1 illustrating a connector member and the wristband seated between a pair of lug members projecting from a sidewall of the watchcase including respective alignment slots in the lug members and a guide pin extending from the wristband into the alignment slots and further including a locking pin (shown in broken line) extending through the connector member.

As noted in FIGS. 2 and 4 the lug members 16, 18 define respective alignment slots 26, 28 within confronting surfaces of the respective lug members 16, 18. The alignment slots 26, 28 extend from an edge 30, 31 of the respective lug members 16, 18 toward the sidewall 20. The lug member 18 further defines an aperture 32 and the lug member 16 defines a recess 33 as will be further discussed hereinafter.

Referring once again to the wristband 12, a connector member 34, mounted within the wristband 12, is adapted for accommodation between the respective lug members 16, 18 as shown in FIGS. 1, 2 and 4. In this preferred embodiment, the connector member 34 is comprised of a rigid metallic insert that is positionally retained within the wristband 12 by a retainer pin 36 interfitting within a channel 37 formed in the connector member 34, that is accessible through the wristband 12.

Referring once again to the wristband 12, a guide pin 38 is extendable through the connector member 34 as shown in FIGS. 2 and 4. The guide pin 38, as noted, projects from each of the longitudinal sides of the wristband 12 and is adapted for engagement within the respective alignment slots 26, 28 for seating the end of the wristband 12. In this regard it should be noted that the connector member 34 defines an abutment surface 40 that includes a ridge or raised surface 42 for mating contact with the sidewall 20 and the notch 24. It should also be noted that the abutment surface 40 has a transverse curvature conforming with the curvature of the sidewall 20.

The wristband 12 also includes a transverse bore 44 that is registrable with the aperture 32. A locking pin 46 is insertable through aperture 32 and the bore 44 for threadable engagement within the recess 33 in the lug member 16 thereby securing the wristband 12 to the watchcase 14.

If should thus be apparent that the locking pin 46 is selectively removeable for detaching the wristband 12. Furthermore, the angular orientation of the lug members 16, 18 and the interaction of the notch 24 and ridge 42 position the flexible wristband 12 for engagement around the wearers wrist without a pivotal connection between the end of the wristband 12 and the watchcase 14 thus providing an integral or continuous connection between the wristband 12 and the watchcase 14.

Additionally, it should be apparent that there is provided a releasable coupling assembly for a wristwatch which achieves the various preferred objects of this invention and which is well adapted to meet conditions of practical use. Since other various possible embodiments might be made of the present invention or modifications might be made in the exemplary embodiment set forth above, it is to be understood that all materials shown and described with reference to the accompanying drawings are to be interpreted as illustrative and not in a limiting sense.

Having thus described the invention, there is claimed as new and desired to be secured by Letters Patent:

1. An coupling assembly for securing a wristband to a watchcase comprising a pair of lug members projecting from a sidewall of the watchcase, said lug members defining opposed alignment slots, an end of said wristband having a connector member, said end of said wristband being adapted for accommodation between said pair of lug members, said connector member defining an abutment surface, a guide pin projecting from said wristband, said guide pin being adapted for engagement within the respective alignment slots for placing the abutment surface of the connector member in contiguous contact with the sidewall, at least one of said lug members further defining a transverse aperture, a bore extending through the wristband, said aperture being registrable with the bore when the abutment surface of the connector member is in contiguous contact with the sidewall, a locking pin selectively extendable through the aperture and the bore for securing the wristband to the watchcase in continuous abutting relationship; the locking pin is arranged substantially parallel to the guide pin when located in the aperture and bore.

2. A releasable coupling assembly as claimed in claim 1 wherein the end of the wristband adjacent to the connector member defines an additional abutment surface conforming substantially to the abutment surface of the connector member.

3. A releasable coupling assembly as claimed in claim 1 wherein the connector member is comprised of a non-flexible material.

4. A releasable coupling assembly as claimed in claim 3 wherein the wristband is comprised of a flexible material.

5. A releasable coupling assembly as claimed in claim 1 wherein the sidewall extending between said pair of lug members defines a curved surface.

6. A releasable coupling assembly as claimed in claim 1 wherein the sidewall is offset from a rear access plate of the watchcase to define a notch coextensive with the sidewall.

7. A releasable coupling assembly as claimed in claim 6 wherein the abutment surface of the connector member includes a ridge, said ridge being accommodatable within the notch in the sidewall when the abutment surface is seated in contiguous contact with the sidewall.

8. A releasable coupling assembly as claimed in claim 1 wherein the abutment surface of the connector member defines a transverse curvature conforming to the curved surface of the sidewall.

9. A releasable coupling assembly as claimed in claim 1 wherein the transverse aperture extends through a first lug member, further including a recess defined in a second lug member, with said locking pin being threadably engageable within the recess.

10. A releasable coupling assembly as claimed in claim 1 wherein the end of the wristband extends on either side of connector member.

11. A releasable coupling assembly as claimed in claim 10 wherein the connector member is retained within the wristband by a retainer pin.

* * * * *